United States Patent [19]

Schmid et al.

[11] 4,109,491

[45] Aug. 29, 1978

[54] THREAD GUIDANCE IN MESH-FORMING MACHINES WITH ROTATING THREAD GUIDES

[76] Inventors: Manfred Schmid, Mörikestr. 8, 7445 Bempflingen; Werner Sommer, Kolpingstr. 51, 7300 Esslingen; Antonius Vinnemann, am bopserweg 11, 7000 Stuttgart 1, all of Fed. Rep. of Germany

[21] Appl. No.: 776,910

[22] Filed: Mar. 11, 1977

Related U.S. Application Data

[63] Continuation of Ser. No. 705,285, Jul. 14, 1976, abandoned.

[30] Foreign Application Priority Data

Jul. 14, 1975 [DE] Fed. Rep. of Germany ..... 2531734

[51] Int. Cl.[2] ..... D04B 3/06

[52] U.S. Cl. ..... 66/125 R

[58] Field of Search ..... 66/125, 126 R, 131, 66/145 R, 145 S

[56] References Cited

U.S. PATENT DOCUMENTS

| | | | |
|---|---|---|---|
| 284,905 | 9/1883 | Salisbury | 66/62 |
| 528,810 | 11/1894 | Salisbury | 66/62 |
| 559,850 | 5/1896 | Johanson | 66/62 |
| 2,821,073 | 1/1958 | Mehnert | 66/64 |
| 3,511,064 | 5/1970 | Major et al. | 66/125 |
| 3,521,466 | 7/1970 | Tannert | 66/125 |

*Primary Examiner*—Ronald Feldbaum

[57] ABSTRACT

An apparatus for feeding a plurality of threads to a knitting machine wherein the thread guides are moving in endless path about the needle bed.

24 Claims, 12 Drawing Figures d)
e)
61
76
70
72
3

THREAD GUIDANCE IN MESH-FORMING MACHINES WITH ROTATING THREAD GUIDES

This is a Continuation, of application Ser. No. 705,285, Filed July 14, 1976 now abandoned.

The invention relates in particular to the return of the free thread ends obtained at the end of the fabric through cutting to the beginning of the fabric in a loop-forming machine having yarn guides revolving along at least one endless path.

A known knitting machine having yarn guides revolving along at least one endless path (German Laid-open Pending Patent Application 1,585,454) has two parallel pairs of needle beds between which a plurality of yarn guides revolve along a path formed by an endless chain and in the process feed threads alternately to one needle bed and the other. In order to avoid the numerous threads stranding or twisting together by reason of the continuous revolving movement of the yarn guides, each yarn guide is mounted on a frame which also carries supply bobbins, yarn eyelets arranged above the needle beds and clamping devices, so that each unit formed out of a yarn guide, a yarn eyelet, a supply bobbin and a clamping device executes a common revolving movement in which the thread end cut at the end of the knitting and then clamped consequently also takes part before it is released again at the beginning of the knitting.

A disadvantage of the described thread guiding system consists in that only relatiely few of the said units can be arranged on a knitting machine, because on the one hand sufficient space is not available for conveying a large number of supply bobbins and on the other hand heavy weights have to be conveyed. Another disadvantage is to be seen in that empty bobbins can be exchanged only when the knitting machine is at a standstill, whereby the productive capacity is considerably reduced.

Another known knitting machine having revolving yarn guides (German Laid-open Pending Patent Application 2,351,741) likewise has two parallel pairs of needle beds, but, in contrast to the first-mentioned knitting machine, comprises stationary supply bobbins, the threads being led from the supply bobbins to the yarn guides through the eyelets of a likewise non-revolving yarn eyelet carrier arranged above the pair of needle beds. Moreover, in order to avoid twisting of the threads, the yarn guides and, with them, the clamping devices do not revolve along a more or less circular or oval path, but along a path after the fashion of an 8, whereby the result is obtained that as the yarn guides revolve in one part of the eight the threads twist together in one twisting direction and as the yarn guides revolve in the other part of the eight they twist in the opposite twisting direction, whereby the twisting first produced is eliminated and, after all the yarn guides have completed a full revolution, the threads have returned to the desired initial position.

This known thread guiding system also has the disadvantage that it is suitable only for guiding a limited number of threads, unless complicated conveying arrangements are provided for the yarn guides and the clamping devices, the cost of which conveying arrangements is much too high in comparison with the total cost of the knitting machine.

The object of the invention is to remove the disadvantages of the indicated state of the art and propose a comparatively cheap thread guiding system which can be carried into effect with simple means.

The special problem underlying the invention is to bring about the return or passing back of the thread ends produced at the end of the fabric by the cutting operation in such manner that the twisting of a plurality of threads cannot occur.

Starting from a method of returning the free thread ends obtained at the end of the fabric through cutting to the beginning of the fabric in a loop-forming machine having yarn guides revolving along at least one endless path, the invention is characterised in that the end of each inner thread is returned to the beginning of the fabric between the two neighbouring threads and those parts of the sheet of threads which are defined by these neighbouring threads and the end of each outer thread is returned to the beginning of the fabric past the sheet of threads formed by the other threads, it being necessary to understand by the two "outer" threads those threads which are arranged at the two outer ends of the sheet of threads in a direction deviating from the upper edge of the needle bed, while all the remaining threads can be described as "inner" threads located inside the sheet of threads.

According to the invention, a thread guiding system for carrying the method according to the invention into effect in a loop-forming machine having at least one needle bed, a plurality of yarn guides revolving along at least one endless path, at least one yarn eyelet carrier through the eyelets of which the threads are guided from supply bobbins to the yarn guides, and at least one thread cutting device at the end of the fabric is characterised by an arrangement by means of which the end of each inner thread can be returned to the beginning of the fabric between the two neighbouring threads and those parts of the sheet of threads which are defined by these neighbouring threads and the end of each outer thread can be returned to the beginning of the fabric past the sheet of threads formed by the other threads.

According to an advantageous further development of the method according to the invention, the return of the inner threads is effected either substantially within a sector of space which is defined by planes formed by the two neighbouring threads during the process of conveyance from the beginning to the end of the fabric, or by the thread ends being first drawn off in the direction of yarn eyelets and then deflected in the direction of the beginning of the fabric, which, for example, can be achieved by means of suction-and-compressed air. Alternatively, all the thread ends may also be returned within a predetermined sector of space which, for example, includes the vertical plane extending through the upper edge of the needle beds.

Further advantageous features of the invention, in particular of the thread guiding system according to the invention, are characterised in the sub-claims.

The invention is described hereinafter with reference to embodiments in association with the accompanying drawing.

Figure 1:
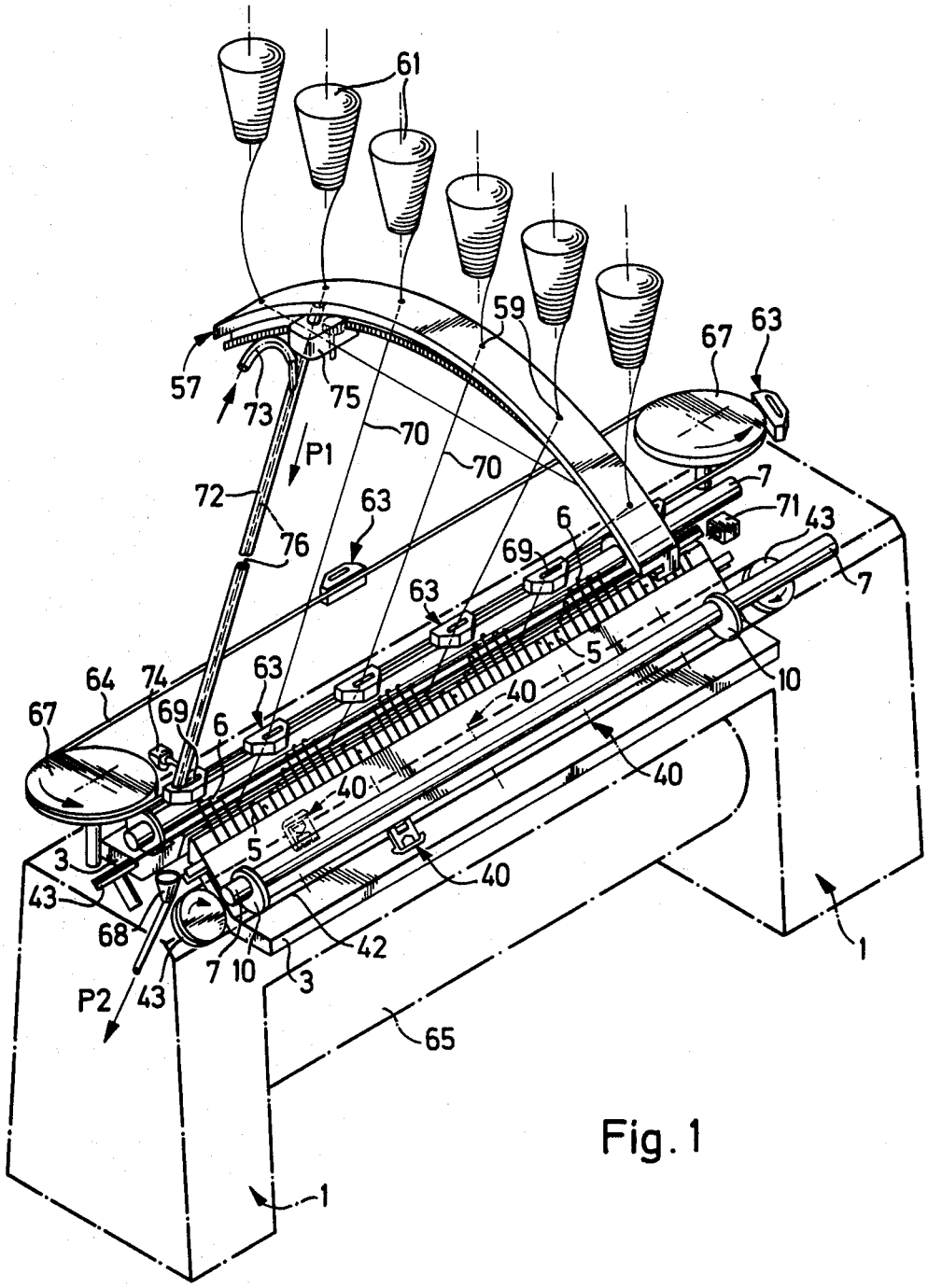
FIG. 1 is a diagrammatic perspective general view of a knitting machine according to the invention.
Figure 2:
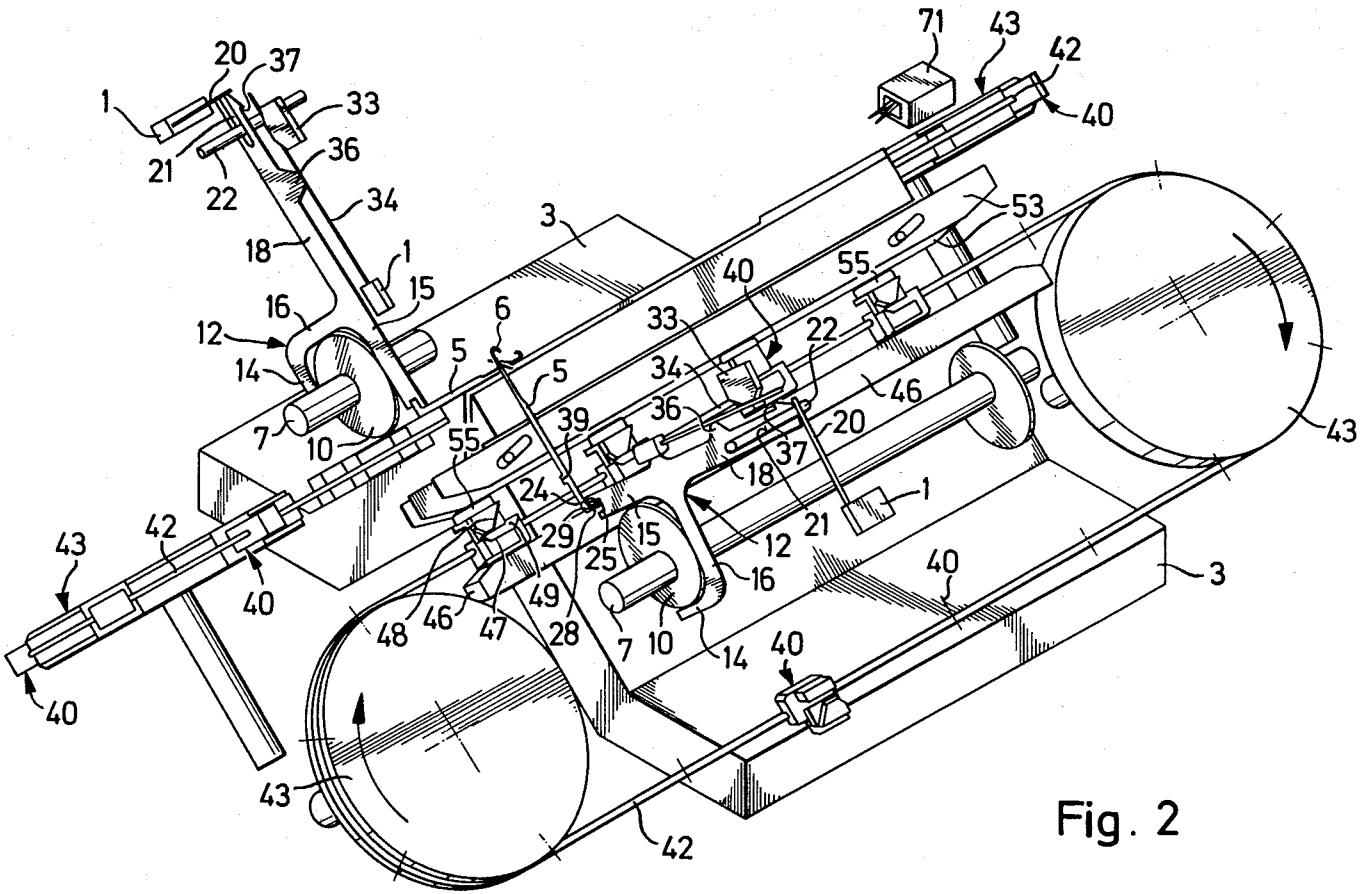
FIG. 2 is a partial view of the knitting machine according to FIG. 1 on a larger scale.
Figure 3:
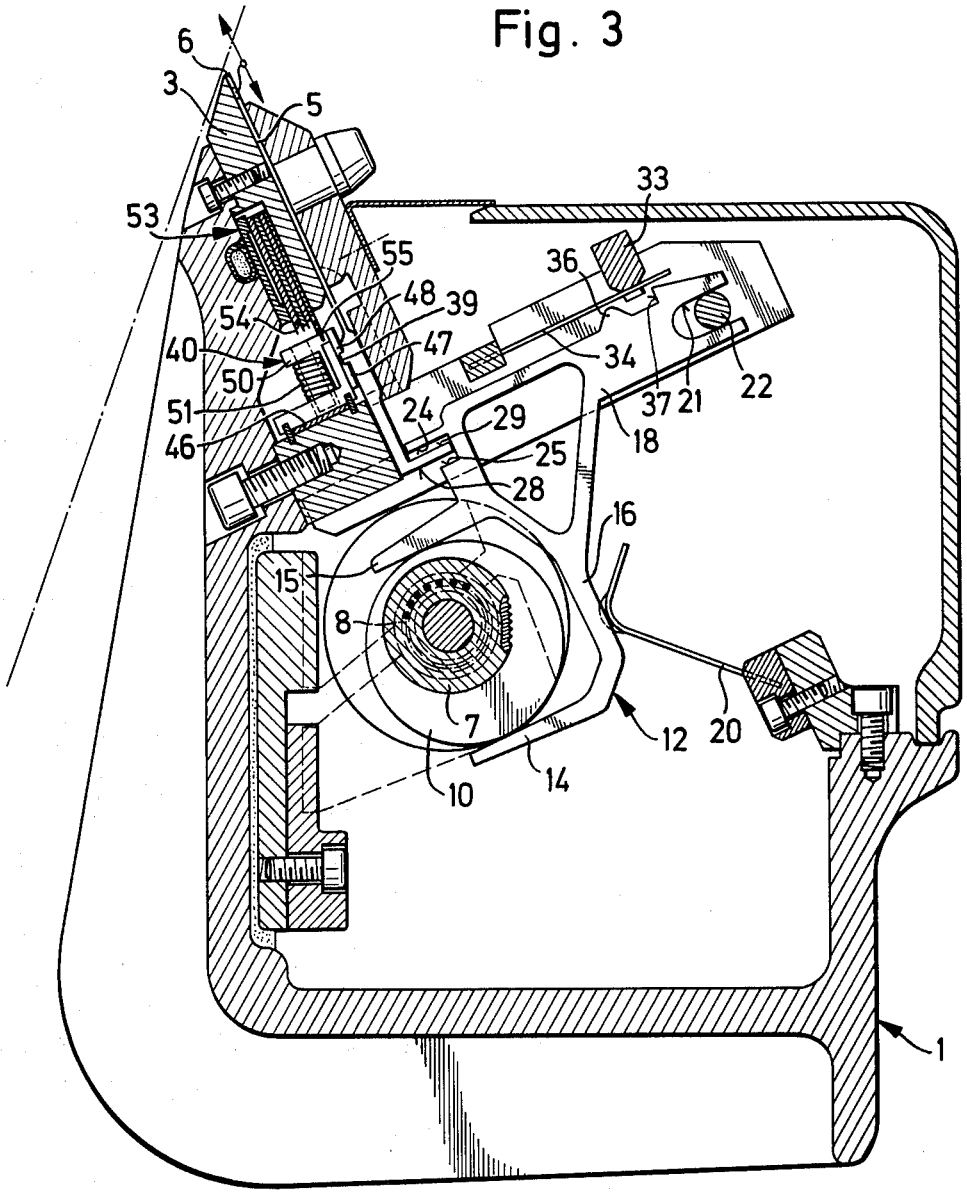
FIG. 3 is a section through a needle bed of the knitting machine according to FIG. 1.

The loop-forming machine according to the invention is illustrated in FIGS. 1 to 3 by the example of a flat knitting machine. Mounted fixedly in V form in a frame 1 are two needle beds 3 in the grooves of which knitting needles 5 with hooks 6, preferably latch needles, are mounted to be longitudinally slidable in known manner. In each needle bed 3, a driving shaft 7 is rotatably mounted in bearings 8. The driving shafts 7 can be rotated at the desired speed by means of drives (not shown). A number of eccentric cam discs 10 corresponding to the number of knitting needles 5 is arranged on the driving shafts 7, the cam discs being rotationally fast with these shafts, each cam disc 10 being arranged in the same plane as the associated knitting needle 5 and having a thickness which is smaller than the distance of the associated knitting needle 5 from the two adjacent needles. Alternatively, the cam discs 10 may be located in a different plane to that of the associated knitting needles 5 and the driving elements 12 may have a suitable bend or crank.

In accordance with FIGS. 2 and 3, on each cam disc 10 there is mounted a driving element 12 which is advantageously located in the same plane as the associated cam disc 10. Each driving element 12 is preferably in the form of a fork having two substantially parallel arms 14 and 15 which are connected by a connecting web 16 arranged substantially at right angles to them and operative as a coupling element. The two arms 14 and 15 embrace the cam disc 10 in the chosen example from two sides in such manner that their points of contact with the cam disc 10 are located on a line extending substantially parallel to the axes of the needles, so that on rotation of the driving shafts 7 the driving elements 12 are raised and lowered parallel to the axes of the needles by the cam discs 10 and in this way perform clearing and camming-down strokes. The cam discs 10 and the driving elements 12 are preferably so designed that, irrespective of the angular position, the two arms 14 and 15 always bear against at least two opposite points on the cam disc 10, so that the driving element 12 is guided positively in each stage of its movement by the cam disc 10. For this purpose, the cam disc 10 does not need to be of circular form, but it is sufficient for it to constitute a lobed cylinder of which all the diameters are of equal length.

Provided on a lateral part of the driving element 12 facing the connecting web 16 is a shank 18 on the end of which, as shown in FIG. 2, there acts a pressure-applying spring 20 fixed to the machine frame 1, which tries to apply the connecting web 16 against the cam disc 10 and, according to FIG. 3, may bear alternatively against a different part of the driving element 12. The shank 18 is mounted in a sliding and pivot bearing which, for example, is formed by a slot 21 in the shank 18 and a pivot pin 22 fixed in the frame 1 and extending through the slot 21, so that on the one hand, by reason of the action of the pressure-applying spring 20, the driving element 12 is held against the cam disc 10 and, on the other hand, by reason of the sliding and pivot bearing 21, 22, is slidably and pivotally mounted. Alternatively, the driving element 12 may advantageously be mounted in a spring 23 (FIG. 27), so that it is able to carry out similar movements to those when it is mounted in the sliding and pivot bearing 21, 22. The spring 23 may at the same time take over the function of the pressure-applying spring 20.

In an upper section of the driving element 12 there is provided a recess the upper edge of which serves as a camming-down portion 24 and the lower edge of which serves as a clearing or driving-out portion 25 for the butt of the knitting needle 5 associated with the recess, the lower edge of which butt is accordingly to be regarded as the clearing means 28, while its upper edge is to be regarded as the camming-down means 29. The camming-down portion 24 has a length such that it overlaps the camming-down means 29 during the camming-down throw of the cam disc 10 in every possible position of the driving element 12, whereas the clearing portion 25 is so short that it overlaps the clearing means 28 only in the coupling position of the coupling element 16 which can be seen in FIGS. 2 and 3 and, on the other hand, is located outside the effective range of the clearing means 28 in an uncoupling position.

For control of the knitting needles 5 according to pattern, a control device is provided for each of the needles and comprises, in the embodiment illustrated, a holding magnet 33 controllable according to pattern and a control spring 34, both of which are fixed in the frame 1. The control spring 34 is clamped at one end and its free end can be applied under initial tension against the polar surface of the holding magnet 33 by means of a projection 36 provided on the shank 18. If the holding magnet 33 attracts the control spring 34, then the connecting web 16 can be applied against the associated cam disc 10 by the pressure-applying spring 20 until the clearing portion 25 overlaps the clearing means 28. On the other hand, if the control spring 34 is not attracted by the holding magnet 33, then it drops from its polar surface by reason of its initial tension and applies itself against an abutment 37 formed on the shank 18, so that in spite of the action of the pressure-applying spring 20 the driving element is arrested in a retracted position and the clearing portion 25 remains ouside the range of engagement of the clearing means 28.

The cam discs 10 arranged on the driving shafts 7 preferably have a constant angular staggering, so that in known manner a shape or course after the fashion of a thread is obtained and those cam discs which are arranged within a pitch form a knitting system. To produce the desired angular staggering, the cam discs 10 may be provided with a suitable inner serration, while the driving shaft 7 are provided with a corresponding outer serration. Alternatively, a spacing disc provided with an inner serration may be arranged between the cam discs in each case, while the cam discs 10 themselves do not have any inner serration, but are mounted almost free from play on the driving shafts 7, so that in the centred state they can be rotated into any position and then be fixed to the spacing discs or the like by cementing. For example, every twenty-four, thirty-six or seventy-two adjacent knitting needles 5 form a knitting system, i.e. every twenty-fourth, thirty-sixth or seventy-second cam disc 10 is mounted on the driving shafts 7 in the same angular position. In the embodiment which can be seen in FIG. 1, every ten adjacent knitting needles 5 form a knitting system and a total of five knitting systems is provided on each needle bed 3. The phase relationship of the two driving shafts 7 may be varied for reasons of knitting technique. In the embodiment shown in FIGS. 1 and 2, each knitting needle 5 has a knitting butt 39 which can co-operate with a plurality of sinker elements 40. The sinker elements 40 are fixed to endless belts 42 which are mounted in each case on at least two guide pulleys 43 or other guide elements and are driven by means of a driving device (not shown). The direction of conveyance is indicated by arrows on the guide pulleys 43. In the region of the two rows of needles, the sinker elements 40 run parallel to the needle beds 3 onto stationary slide rails 46 extending over the entire width of the needle beds, so that they may always be arranged at the same unvarying height while they are travelling past the knitting needles 5. Each sinker element 40 has a first cam 48 operative in the camming-down direction and a second cam 47 rising in the clearing direction, which together form a trick 49 into which the knitting butts 39 of the knitting needles 5 run in order first to be cammed or drawn down by the first cam 48 for the purpose of forming a loop and then to be brought back into the normal run-through position by the second cam 47.

As can be seen in particular from FIG. 3, the second cam 47 is secured to a fixed part of the sinker element 40, whereas the first cam 48 is mounted slidably on the sinker element 40 and has an arm 50 on which a compression spring 51 mounted on the sinker element 40 acts. At least one slide rail 53 extending over the entire width of the needle beds 3 and adjustable in height serves as a counter-bearing for the upper edge of the cam 48. Preferably, a plurality of such adjustable slide rails 53 are provided, these having a guide 54 on their side facing the upper edge of the cam 48. In a number of grooves corresponding to the number of these guides 54, which are formed in the upper edge of the arm 50, plates 55 selected according to pattern can be inserted individually, the upper edges of these plates entering the guide 54 associated with them and thereby fixing the distance between the two cams 47 and 48. In this way, the sinking depth of the knitting needles 5 can be adjusted differently by the cams 48.

The sinker elements 40 are arranged at such a height relative to the knitting butts 39 that the latter can enter the trick 49 only after the knitting needles 5 have been cammed down almost as far as the normal run-through position by means of the camming-down portions 24 of the driving elements 12. The cams 48 therefore become operative only at the end of a complete camming-down throw of the cam discs 10 and produce only that small part of the camming down which serves to form a loop or draw the loop of yarn formed by a hook 6 through the previously formed loop disposed on the needle shank, whereas the major part of the camming down is carried out with the aid of the driving element 12 driven positively by the cam disc 10. In order to avoid the additional camming-down stroke produced by the can 48 disturbing the camming-down stroke produced by the driving element 12, the arrangement is such that the distance between the camming-down portions 24 and the clearing portions 25 of the driving elements 12 is about as much greater than the distance between the clearing means 28 and the camming-down means 29 of the knitting needle 5 as corresponds to that additional camming-down stroke which can be achieved at the most with the camming-down or lowering cam 48, i.e. the driving connection of the knitting needle 5 with the cam disc 10 has so much play that the knitting needle 5 is movable in the direction of its movement by a sufficiently large distance in addition to the movement produced by the cam disc 10.

The distance between neighbouring sinker elements 40 on the belts 42 corresponds to the distance between the knitting systems expressed by the number of needles. The conveying speed of the belts 42 is so synchronized with the rotation of the driving shafts 7 that the first cams 48 always to act on a knitting butt 39 when the associated knitting needle 5 has been cammed down or lowered almost as far as the run-through position by the associated driving element 12.

The arrangement shown in FIG. 1 may, for example, be employed for supplying the yarn. Above the machine frame there is arranged a carrier 57 for yarn eyelets 59 which is disposed substantially in the middle of the needle beds 3 and at right angles to them and is so curved that all the yarn eyelets 59 are at substantially the same distance from the gap extending between the two needle beds 3. Above the yarn eyelets 59 there are provided in a creel (not shown) as many yarn bobbins 61 as there are yarn eyelets 59, it also being possible for reserve bobbins to be provided in known manner in case of need.

In the region of the hooks 6 of the knitting needles 5, referred to their clearing position, a plurality of yarn guides 63 is provided. The yarn guides are fixed to endless belts 64 which are mounted in each case on at least two guide pulleys 67 or other guide elements and are carried past the knitting needles along a line parallel to the needle beds 3 by means of a driving device (not shown). Each yarn guide 63 has an eye 69 into which a thread 70 coming from some yarn bobbin 61 can be placed. During movement of the yarn guides 63 in the direction of the arrows on the guide pulleys 67, a cutting device 71 known per se for the threads 70 is located at the ends of the needle beds 3 which are on the right in FIG. 1. This cutting device has the function of cutting off the thread 70 offered by any yarn guide 63 as soon as it has been seized by the hook 6 of the last knitting needle 5 which works up this thread.

In order to carry the yarn end which becomes free through the cutting operation back to the end of the needle beds 3 which is on the left in FIG. 1, there is provided a blowing tube 72 through which compressed air is forced in the direction of the arrows P1 by means of a flexible tube 73 connected to a source of compressed air. The lower end of the blowing tube 72 is arranged in close proximity above that point at which the eyes 69 provided in the yarn guides 63 travel past and, for example, is mounted in a ball-and-socket joint 74 or the like. Associated with the blowing tube 72 is a swinging mechanism 75 which is basically of any kind and by means of which the upper end of the blowing tube 72 can be arranged close below each yarn eyelet 59. Each blowing tube 72 moreover has a lateral slot 76 extending through from top to bottom and directed towards the right-hand end of the needle beds 3 in FIG. 1 and which, in case of need, may be covered with an elastic material fixed along one edge of the slot, this elastic material, on the one hand, ensuring satisfactory conveyance of the thread in the blowing tube, yet on the other hand rendering possible lateral withdrawal of a thread in the blowing tube through the slot. Finally, the upper end of the blowing tube is so designed that, in conjunction with the compressed air supplied, it exerts a combined sucking and blowing action. The result of this is that a length of yarn hanging down through a yarn eyelet 59 and free at the end and therefore uncontrolled is, on the one hand, drawn to the upper end of the blowing tube 72 and, on the other hand, conveyed from there through the blowing tube 72 to its lower end, after adjustment of the upper end of the blowing tube 72 to the said yarn eyelet 59.

Figure 8:
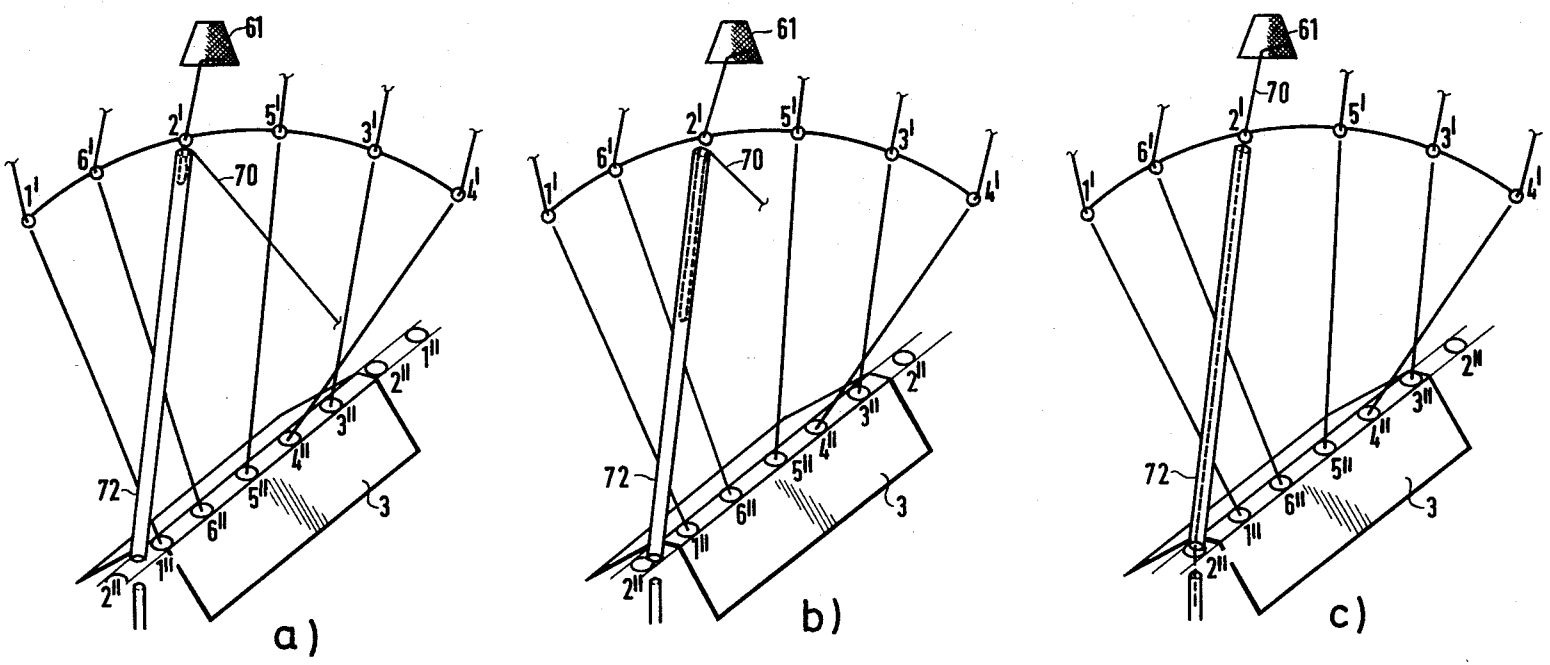
Figure 8:
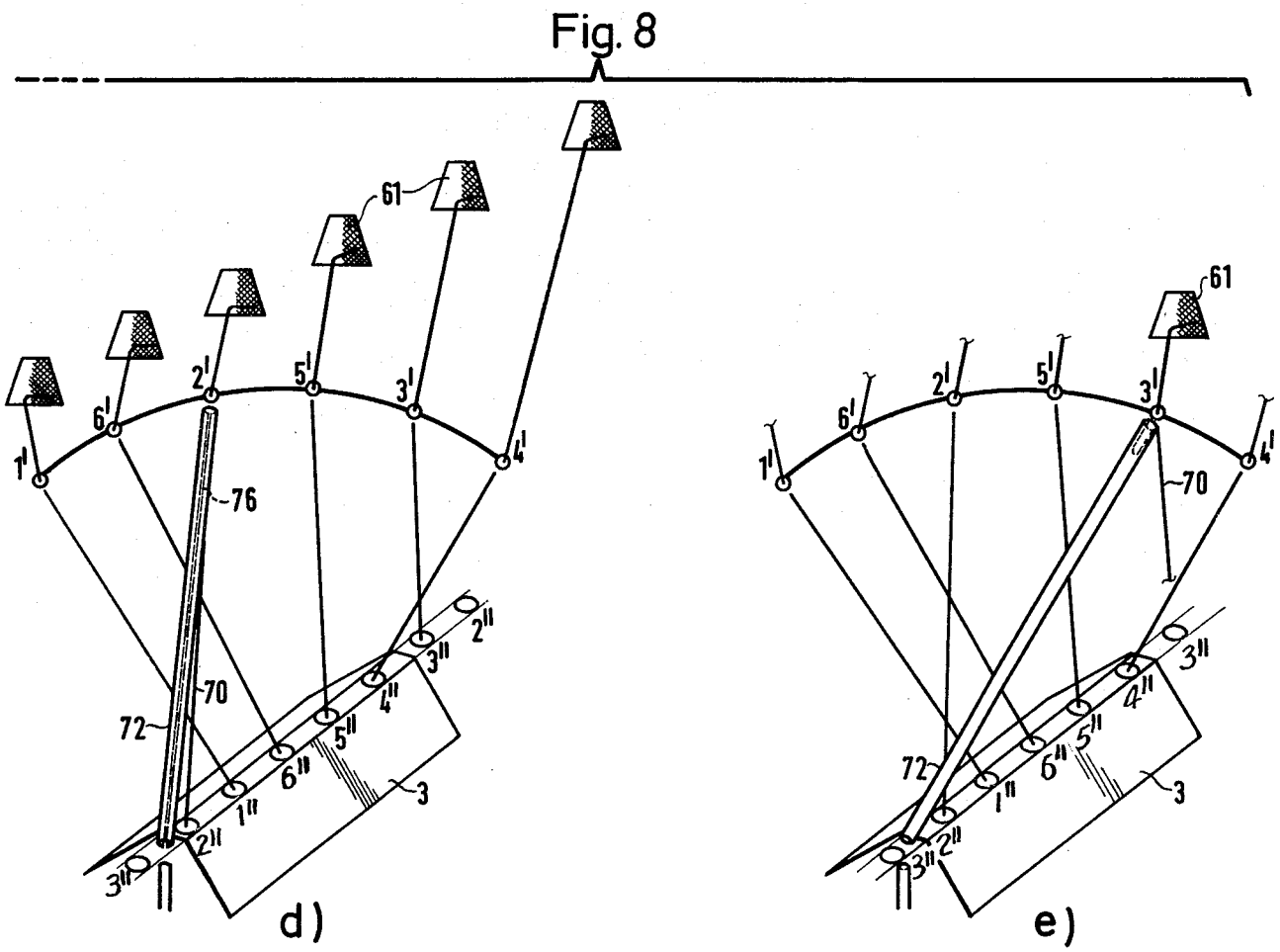

The sequence of steps for carrying the thread back by blowing tube 72 is described more in detail with respect to FIGS. 8(*a*) – 8(*e*) in which the yarn eyelets are numbered 1' to 6' and the yarn guides associated with the eyelets are numbered correspondingly 1'' to 6''. To convey the threads to the beginning of the needle bed after cutting them at the end of the needle bed the following steps are necessary.

In FIG. 8*a* the upper end of blowing tube 72 is directly arranged below the yarn eyelet 2' while the lower end of the blowing tube is arranged in a middle position between the yarn guides 2'' and 1''. The thread belonging to yarn eyelet 2' has been cut at the end of the needle bed and will be moved into the blowing tube as shown in dotted lines and then transported toward the beginning of the needle bed. FIG. 8*b* shows on the one hand that the thread is moved relatively deep into the blowing tube and that the front yarn guide 2'' approaches the end of the blowing tube. In FIG. 8*c* the yarn guide 2'' is arranged directly below the lower end of the blowing tube so that the thread can be inserted in said yarn guide. The yarn guide 3'', however, is at this time close to the end of the needle bed. FIG. 8*d* shows that the thread being inserted into the yarn guide 2'' is removed from the lateral slit 76 of the blowing tube because of the fact that the yarn guide 2'' is moved in the direction toward the end of the needle bed. It can furthermore be seen that the lower end of blowing tube is in a middle position between two yarn guides 3'' and 2'' and that the other yarn guide 3'' has reached the end of the needle bed so that the thread can be cut. As soon as the thread in guide 2'' is completely removed from the blowing tube 72 said blowing tube is turned to a new position. This position is shown in FIG. 8*e* according to which the upper end of blowing tube is now arranged below the yarn eyelet 3' so that the appertaining thread can be sucked into the blowing tube. The relative positions of the different parts in FIG. 8*e* correspond to FIG. 8*a* except for the distinction that the upper end of the blowing tube was turned and that the yarn guide 3'' is now arranged close to the lower end of blowing tube.

In order to clamp the free yarn end conveyed from the end of the needle beds 3 to the beginning of the needle beds 3 by means of the blowing tube 72, it is possible to provide at the left-hand end of the needle beds 3 in FIG. 1 either a conventional yarn clamping device (not shown) or a pneumatic suction device 68, by means of which the yarn end is retained with the aid of suction or intake air at least until the thread 70 has been inserted in a number of hooks 6 and has been worked up by them into a loop.

The yarn guides 63 are arranged on the belts 64 at intervals which correspond to the width of the knitting systems expressed by the number of needles. The conveying speed of the belts 64 is so synchronized with the speed of the driving shafts 7 that a thread 70 is offered to the open hooks 6 of the cleared knitting needles 5 shortly before these knitting needles 5 selected for knitting are cammed down by means of the driving elements 12 and then by means of the sinker elements 40.

If a three- colour pattern is to be produced on the five-system or five-feed knitting machine shown in FIG. 1, then six yarn bobbins 61, for example, are used for this purpose, each two yarn bobbins 61 being furnished with yarn of the same colour. The following operations therefore occur in constant repetition and may partly overlap. On the one hand, the thread carried past the hooks 6 of the selected knitting needles by any yarn guide 63 is cut off at the right-hand end of the needle beds 3, i.e. at the end of the knitted fabric, so that the thread hangs down freely from the associated yarn eyelet 59 and the associated yarn guide 63 can travel back at a rear part of a needle bed 3 to the left-hand part of the needle beds, i.e. to the beginning of the knitted fabric. On the other hand, after a thread conveyed in the blowing tube 72 to the beginning of the knitted fabric has been withdrawn through the lateral slot, the upper end of the blowing tube is adjusted to the eyelet 59 of that thread whose end is to be carried back, whereby this thread is sucked up in the direction of the eyelet 59, conveyed through the blowing tube 72 to the beginning of the knitted fabric, threaded into the eye 69 of the next yarn guide 63 travelling past below the lower end of the blowing tube 72 and finally retained at the beginning of the knitted fabric before this next yarn guide 63 comes into the insertion position for the first knitting needles 5. Since there are five systems or feeds, whereas there are six threads, a thread is always free in this way for being carried back.

A thread 70 which has been inserted in the eye 69 of a yarn guide 63 with the aid of the blowing tube 72 travels in the direction of the end of the knitted fabric together with this yarn guide. Since the thread end is first retained at the beginning of the knitted fabric, the thread is withdrawn through the slot of the blowing tube 72 by reason of the movement of the yarn guide, this withdrawal commencing in the lower part of the blowing tube 72 until, after the yarn guide has moved past a certain number of knitting needles 5, the entire length of thread between the yarn guide 63 and the yarn eyelet 59 has been drawn out of the blowing tube 72, so that its upper end can be adjusted to the eyelet 59 of the thread to be conveyed subsequently in good time before the arrival of the next yarn guide 63.

In dependence upon the number of knitting systems and the number of colours required, a plurality of blowing tubes may also be employed and their working cycles then partly overlap. Finally, by control of the blowing tube, it is possible to vary the sequence of the threads to be worked up in any desired manner. For winding down and batching or taking up the knitted fabric produced during the operation of the knitting machine, a winding-down and batching arrangement 75 is provided, this being accommodated below the gap in the frame 1 between the two needle beds 3.

The knitting machine described operates in the following manner: To knit a single-colour knitted fabric without any pattern, the control springs 34 are constantly attracted by the holding magnets 33, so that they remain constantly swung out of the range of the abutment 37 of the shank 18. In consequence, if the movement of any knitting needle 5 is considered, the associated cam disc 10 first moves the driving element 12 mounted on it upwardly, the clearing portion 25 of the driving element 12 engaging below the clearing means 28 of the knitting needle 5 by reason of the action of the pressure-applying spring 20 and raising the knitting needle until the clearing throw of the cam disc 10 has been completed and the knitting needle 5 has reached its highest position. At this moment, a yarn guide 63 travels past the opened hook 6 of this knitting needle 5, so that a thread 70 is inserted and is drawn into a loop by the hook 6 during the following camming-down throw of the cam disc 10. During the first half of this camming-down throw, the cam disc 10 presses simultaneously against the connecting web 16 which is operative as a coupling element, so that this connecting web is also shifted, together with the entire driving element 12, in a direction at right angles to the axis of the knitting needle 5 in opposition to the force of the pressure-applying spring 20. During this movement, the camming-down portion 24 remains constantly in engagement with the camming-down means 29 of the knitting needle 5. Since the control spring 34 is retained by the holding magnet 33, the driving element 12 is shifted back again during the second half of the camming-down throw of the cam disc 10 in the direction at right angles to the axis of the knitting needle 5 by reason of the action of the pressure-applying spring 20, so that the clearing portion 25 of the driving element 12 is again coupled with the clearing means 28 of the knitting needle at the beginning of the next clearing throw of the cam disc 10.

After completion of the camming-down throw, a sinker element 40 has reached such a position that its cam 48 begins to act on the knitting butt 39 of the knitting needle 5 located in the run-through position and imparts to the knitting needle 5 a sinking stroke the size of which has been adjusted beforehand to the desired value by means of the slide rails 53, while at the same time the cam disc 10 begins its clearing throw, so that the knitting needle 5 is brought into its highest position again after completion of the sinking stoke. When the knitting needle 5 has reached this highest position again, the next yarn guide 63 is then in range of its hook 6, so that a thread can again be inserted.

If a pattern is to be produced by the knitting needle 5 considered remaining in the run-through position during a clearing throw of the cam disc 10, then a control signal is so supplied to the holding magnet 33 that the control spring 34 drops off by reason of its initial tension and applies itself against the abutment 37 when the driving element 12 moves back in the direction at right angles to the axis of the needle. The connecting web 16 and also the driving element 12 are thereby arrested in a position in which the clearing portion 25 is outside the effective range of the clearing means 28 and consequently the knitting needle 5 is not raised during the clearing throw of the cam disc 10. Since, however, the driving element 12 is raised with each clearing throw, the projection 36 is applied against the control spring 34 and presses its end against the polar surface of the holding magnet 33 again, so that a fresh selection can be carried out.

Finally, if a multi-coloured pattern is to be produced, then on the one hand threads 70 of different colours are supplied to the yarn guides 63, while on the other hand the holding magnets 33 associated with the knitting needles 5 are suitably triggered, so that a Jacquard knitted fabric is produced in the usual manner. In this case, however, a course is not formed as each individual yarn guide 63 passes by the needle beds 3, but a number of yarn guides corresponding to the number of colours must be carried past the needle beds to form a course.

The production of stripe patterns is possible without triggering the holding magnets 33 in that only threads of a certain colour are blown into the eyes 69 of the yarn guides 63 by means of the blowing tube 72 over a certain number of courses and then a change is made according to pattern to the threads of a different colour.

Figure 4:
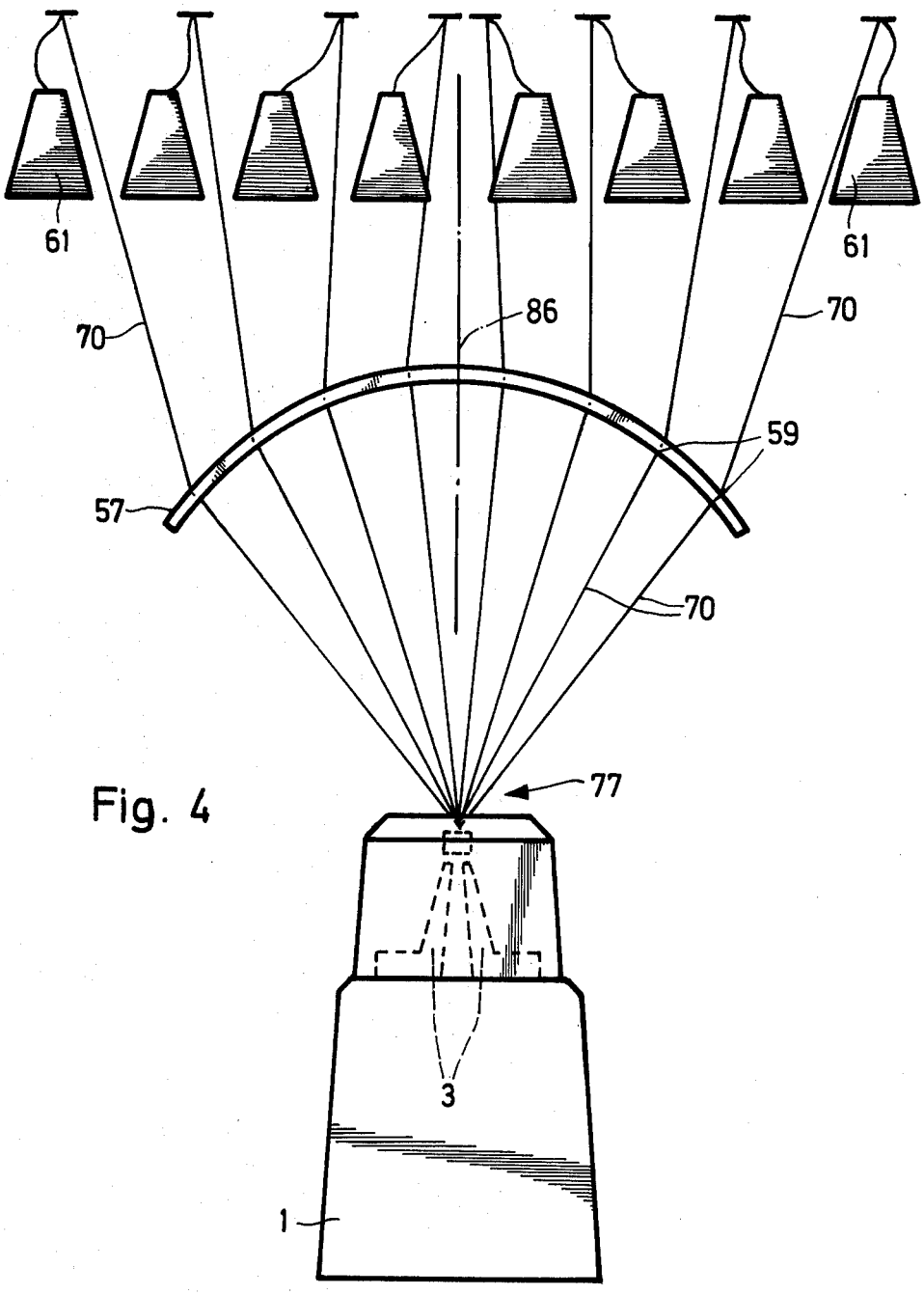
FIG. 4 is a diagrammatic front view of the thread guiding system according to FIG. 1.

In accordance with the description so far, the thread ends are first drawn off in the direction of the yarn eyelets 59 at a point in the vicinity of the yarn eyelets by a combined sucking and blowing process and are then deflected and carried back in the direction of the beginning of the fabric. In the process, the entire blowing tube, irrespective of its swung position, is always located above the sheet of threads 77 (FIG. 4) formed by the threads 70, so that it cannot impede the conveyance of the threads 70 already inserted in the yarn guides.

Figure 5:
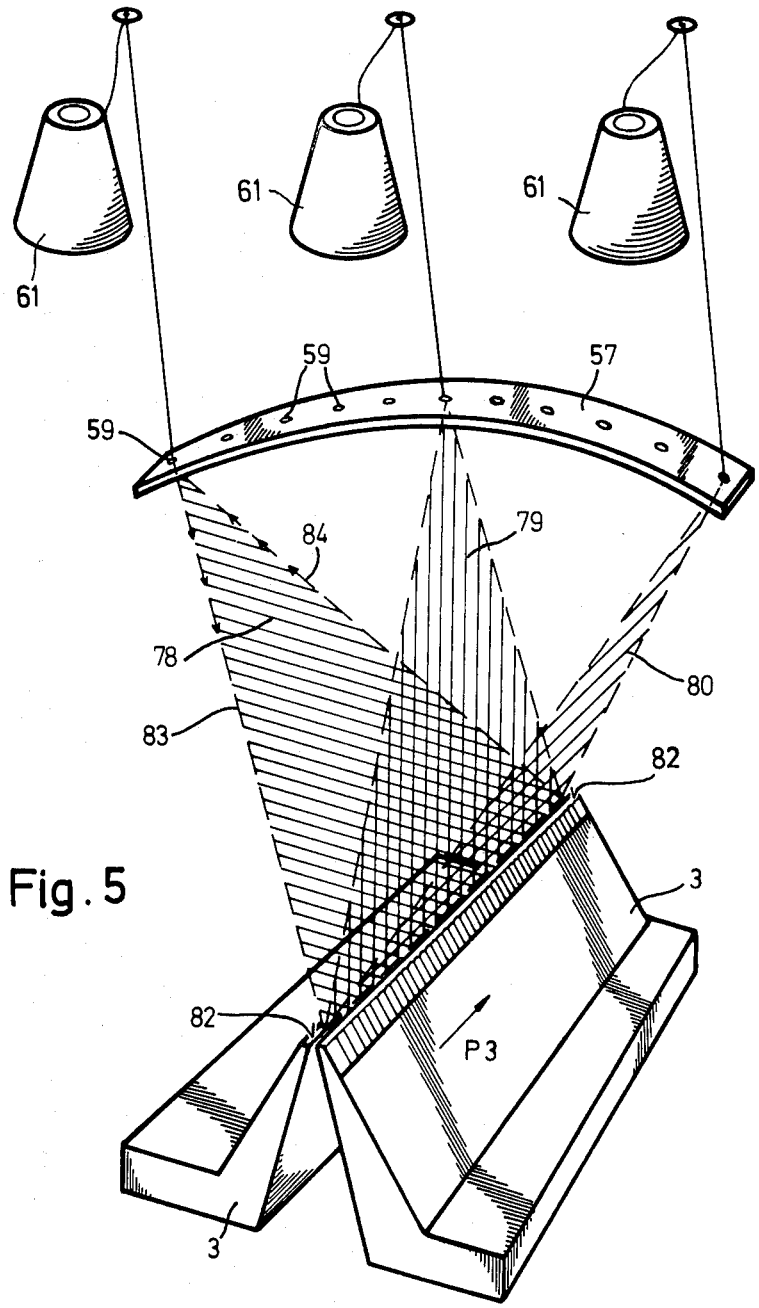
FIG. 5 is a diagrammatic perspective view of a thread guiding system according to the invention.

As can be gathered in particular from the diagrammatic perspective view according to FIG. 5, each thread is guided in a plane 78 to 80 which is formed substantially by the upper edge 82 of the needle beds 3 and the associated yarn eyelet 59. During the continuous knitting process, for example, the thread passed through the eyelet 59 which is on the extreme left in FIG. 5 is first located at the beginning of the fabric and adopts the position indicated by a line 83 at the edge of the plane 78. During the conveyance of this thread by means of the associated yarn guide in the direction of the arrow P3, the threads travels along the plane 78 until it has reached the end of the fabric and consequently adopts the position indicated by a line 84. After the cutting operation, this thread is then carried back substantially along the line 84 to the yarn eyelet 59 and from there along the line 83 to a yarn guide again.

The threads defined by the planes 78 and 80 in FIG. 5 may be described as outer threads which define on the outside the sheet of threads 77 (FIG. 4) formed by all the threads. All the remaining threads and therefore also the thread defined by the plane 79, are located inside the sheet of threads 77 and can be described as inner threads.

The invention can therefore also be defined in a most general way by stating that the end of each outer thread (planes 78 and 80) is returned on the outside past the sheet of threads 77 to the beginning of the knitted fabric, whereas the end of each inner thread (plane 79) is carried back to the beginning of the knitted fabric in each case between its two neighbouring threads and those two parts of the sheet of threads 77 which are defined by these neighbouring threads. Moreover, during the entire knitting process, the inner threads are arranged within a sector of space which is defined by planes formed by the upper edge 82 of the needle bed and the two planes which are formed by the neighbouring threads during conveyance from the beginning of the fabric to the end thereof, if the fact that the free thread ends may leave this sector of space briefly during their drawing-off in the direction of the yarn eyelets 59 is disregarded.

Instead of arranging the blowing tube swingably and the yarn eyelet carrier 57 fixedly, the blowing tube may be arranged fixedly and the yarn eyelet carrier 57 may be arranged so that it is movable in the direction of the line of its periphery. In this case, the blowing tube is preferably arranged in that vertical plane indicated in FIG. 4 by the chain-dotted line 86 which extends substantially through the upper edges of the needle beds 3, while the yarn eyelet carrier 57 is so moved that that eyelet 59 is arraged in correct time at the upper end of the blowing tube, whose thread is to be returned. In this way, all the threads 70 are returned within one and the same sector of space. Twisting of the threads is not possible in both of the embodiments described.

Instead of the blowing tube 72 (FIG. 1), a mechanical arrangement may also be provided for conveying the thread ends back to the beginning of the knitted fabric. According to FIGS. 6 and 7, a number of clamping means 89 are provided for this purpose on an endless revolving belt 88. The belt 88 is carried on guide pulleys 91 to 95, at least one guide pulley being positively driven. The direction of rotation of the guide pulleys is indicated by arrows. The yarn eyelet carrier 57 is provided at its back with a dovetail-like guide 98, which is slidably mounted in a corresponding groove in a supporting frame 99 arranged perpendicularly to the upper edge 82 of the needle bed. For shifting the yarn eyelet carrier 57 in the directions indicated by the double arrow P4, a pinion 101 is mounted in the supporting frame 99 and co-operates with a rack 102 fixed to the yarn eyelet carrier 57 and, for example, is driven by a reversible stepping motor.

Figure 6:
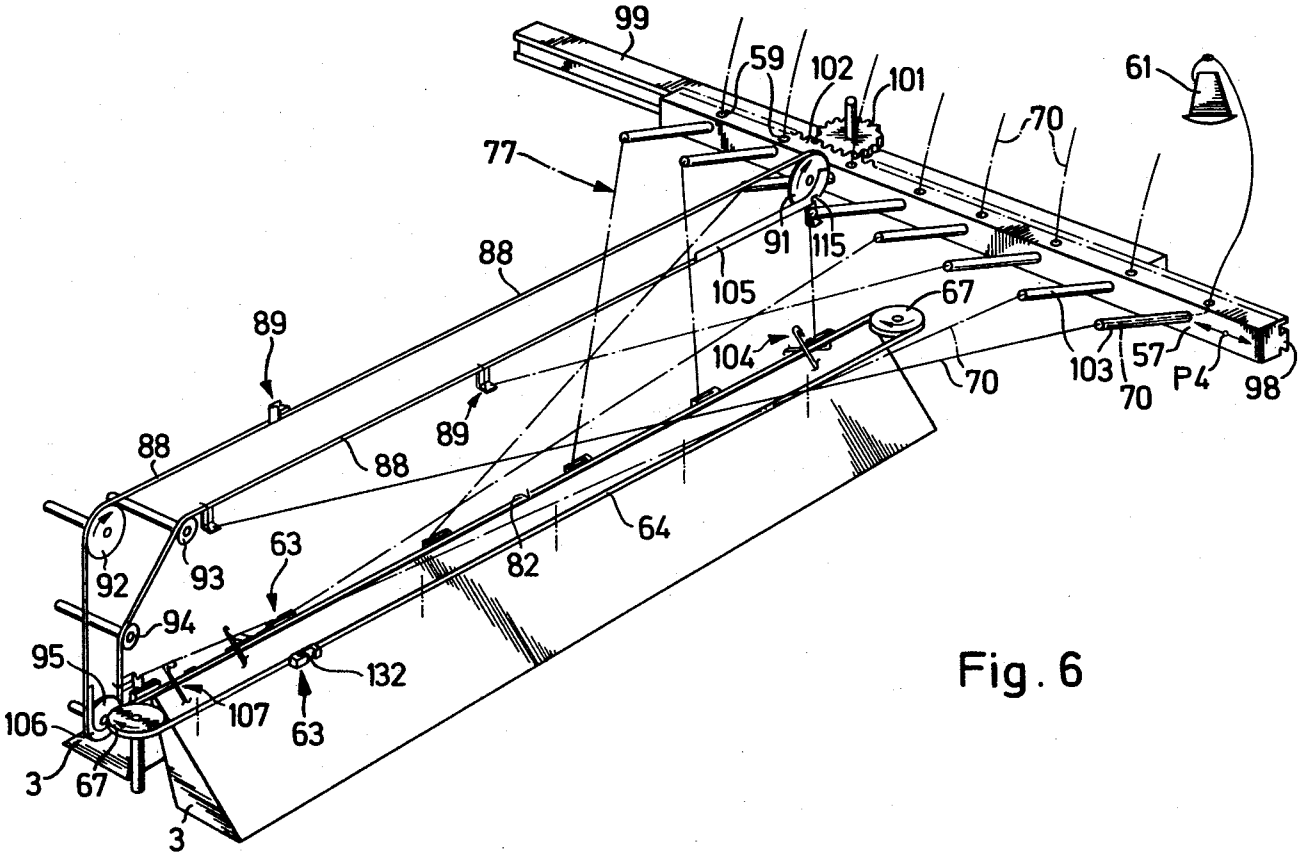
FIG. 6 is a diagrammatic perspective view of another constructional form of the invention.

Moreover, to the yarn eyelet carrier 57 there are fixed yarn guiding tubes 103 through which the threads 70 coming from the yarn eyelets 59 are passed. The yarn guiding tubes 103 extend in a plane parallel to the upper edge 82 of the needle bed, but are arranged obliquely in this plane with respect to the upper edge of the needle bed. The length of the yarn guiding tubes 103 is preferably so chosen that their exit openings are arranged substantially in a vertical plane extending transversely of the upper edge of the needle bed a short distance in the knitting direction behind a cutting device 104 provided at the end of the knitted fabric. The cutting device 104 may consist, for example, as indicated in FIG. 6, of two hooked elements each inserted in the needle beds 3 in place of a knitting needle and which have a cutter at their inner sides and, like the knitting needles, are driven by a cam disc, so that they go through a complete cutting cycle during each revolution of the driving shafts.

The guide pulleys 91 to 95 are advantageously all arranged in a vertical plane parallel to the upper edge 82 of the needle beds. The guide pulley 91 is moreover in the immediate vicinity of the yarn eyelet carrier 57 and deflects the clamping means 89 downwardly at this point in such manner that they take up the thread 70 hanging down out of the associated yarn guiding tube 103 and already cut and convey it outside the sheet formed by the threads in the direction of the beginning of the fabric. At the beginning of the fabric, the two guide pulleys 93 and 94 serve to deflect the clamping means 89 downwards vertically, so that the threads clamped by them may be inserted in a yarn guide 63 traveling past. The clamping means are then conveyed back to the yarn eyelet carrier 57, likewise outside the sheet of threads, by the guide pulleys 92 and 95. Slide rails 105 and 106 are arranged in the region of the guide pulleys 91 and 95, respectively, and control the operation of the clamping means 89.

Moreover, at the beginning of the fabric there is arranged a clamping device 107 which likewise consists of two hooked elements which are mounted in the needle beds 3 in place of knitting needles and are actuated by means of cam discs, so that they go through a complete clamping cycle with a revolution of the driving shafts. The clamping device 107 has the function, in corresponding fashion to the suction device 68 according to FIG. 1, of retaining the ends of the threads inserted in the yarn guides 63 until the thread has been entangled by a number of knitting needles.

Figure 7:
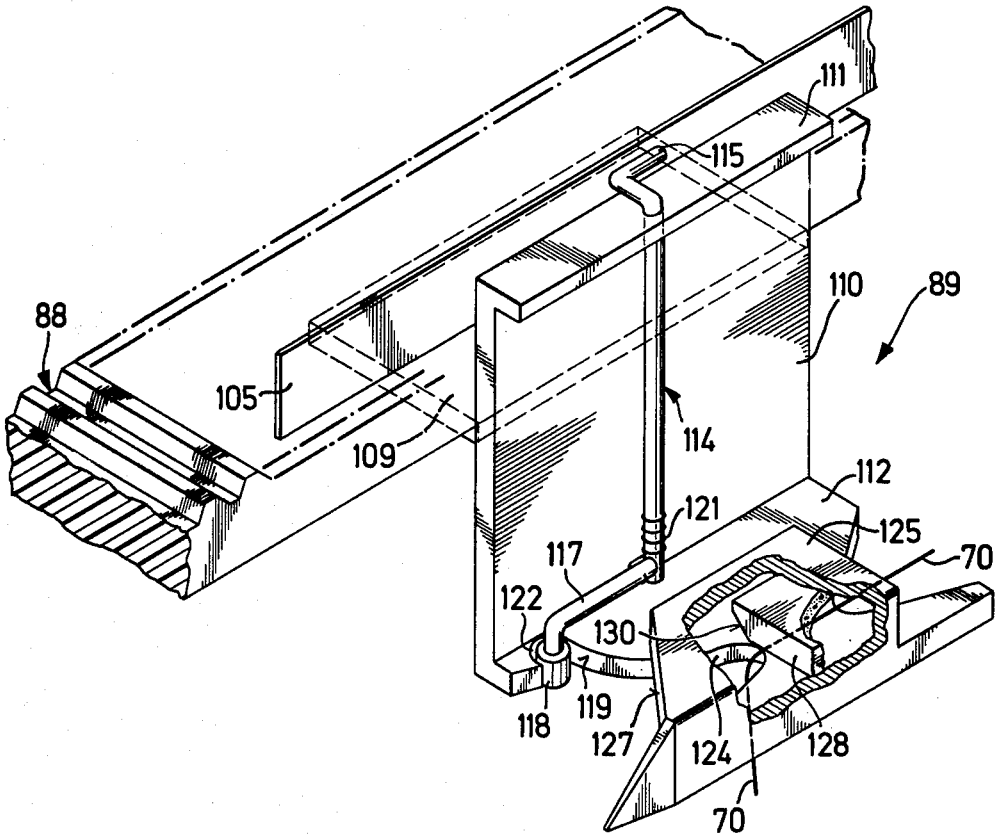
FIG. 7 is a view on a larger scale of a clamping means of the thread guiding system according to FIG. 6, and FIGS. 8(*a*) - 8(*e*) show schematically the sequence of steps during the operation of the thread guiding system shown in FIGS. 4 and 5.

The design of a clamping means 89 can be seen in particular from FIG. 7. On a support 109 secured to the belt 88 there is fixed a supporting plate 110 bearing in its upper part a projection 111 and in its lower part a base plate 112 arranged at right angles to the supporting plate 110. The projection 111 and the base plate 112 each contain a pivot bearing for a swing lever 114 having an arm 115 bent at right angles at its upper end. At the lower end of the swing lever 114 there is provided an arm 117 likewise bent at right angles and the outer end of which carries a cylindrical clamping element 118 which, on rotation of the swing lever 114, slides along a circularly curved guide surface 119 formed on the base plate 112. Around the swing lever 114 there is wound a spiral spring 121, one end of which is supported against the supporting plate 110, while the other end engages the lower arm 117 of the swing lever 114.

The guide surface 119 is defined at one end thereof on the left in FIG. 7 by a stop 122. The right-hand end of the guide surface, on the other hand, is curved in the form of a V, the contour 124 formed in this way having a diameter corresponding to the diameter of the clamping element 118.

At the outer end of the base plate 112 there is fixed a guide plate 125 which is arranged a little above the base plate and parallel thereto. The guide plate 125 has at its front end, on the left in FIG. 7 an inclined sliding edge 127, the inclination of which extends towards the guide surface 119 and which ends at a middle part of the guide surface 119. In the gap between the guide plate 125 and the base plate 112, a brake pad 128 consisting of foam rubber or the like is provided at a point adjacent the contour 124 of the guide surface 119, the brake pad being fixed only at the top to the guide plate 125 and leaving free between its underside and the base plate 112 a gap corresponding approximately to the thickness of the thread 70. The size of the gap can be adjusted by varying the thickness of the brake pad 128. Alternatively, the brake pad may be fixed to the guide plate 125 by means of adjusting screws, so that if there is a change in the thickness of the yarn the size of the gap can be adjusted with a knob. In the direction of the supporting plate 110, the brake pad 128 terminates flush with the guide plate 125 and has an inclined surface 130 extending in the direction of the base plate 112. In the direction of the supporting plate 110, the space between the base plate 112 and the guide plate 125 is open.

The mode of operation of the arrangement described is as follows.

After insertion of a thread in a yarn guide in the region of the beginning of the fabric, the yarn guide is conveyed to the end of the fabric at knitting speed, the thread being inserted in the hooks of the selected knitting needles. After the thread has been inserted in the hook of the last knitting needle selected, the cutting device 104 is actuated, whereby the thread is cut and the thread end hangs down freely substantially in the manner which can be seen in FIG. 6. In the meantime, the yarn eyelet carrier 57 has been so moved by means of the pinion 101 that the free end of the yarn guiding tube associated with the cut thread is arranged close beside the guide pulley 91. The result achieved by the inclined arrangement of the yarn guiding tube 103 is that, while the outer end of the base plate 112 of the next clamping means 89 deflected downwardly by the guide pulley 91 can be carried close past the yarn guiding tube 103, after completed deflection of the clamping means 89 the sliding edge 127 is nevertheless located close below the exit opening of the yarn guiding tube 103 and immediately behind the thread whose end is to be carried back to the beginning of the fabric.

After commencement of the deflection of the clamping means 89, the end of the swing lever 115 runs onto the slide rail 105 and is consequently swung into the position shown in FIG. 7 in opposition to the action of the spring 121.

On the further movement of the clamping means 89 (to the left in FIGS. 6 and 7), the free end of the thread slides along the sliding edge 127 and the top of the guide plate 125 in the direction of the supporting plate 110, until it finally reaches the end of the guide plate 125 and drops from this onto the base plate 112, the outer end of the thread now being applied against the guide surface 119. In the further course of events, the thread then enters the gap between the brake pad 128 and the base plate 112 by reason of the action of the guide surface 119 and the inclined surface 130. Although the free end of the thread is now guided controlledly, the braking action of the brake pad 128 is not so strong that the yarn could be drawn off the supply bobbin in opposition to the action of yarn brakes arranged behind the yarn eyelets 59. On the contrary, the free end of the thread slides controlledly through the said gap, while at the same time its outer end is drawn through the contour 124.

The clamping means 89 now reaches the end of the slide rail 105. This causes the swing lever to turn through about 90° by reason of the action of the spring 121, until the clamping element 118 bears firmly against the contour 124 formed in the guide surface 119 and thereby clamps the thread. If the distance of the end of the slide rail from the exit opening of the associated yarn guiding tube is a little shorter than the distance of the exit opening of the yarn guiding tube from the cutting device 104, it is ensured that the free end of the thread is clamped practically in its last part.

The clamped thread is now conveyed in the direction of the beginning of the fabric by the clamping means 89 in opposition to the action of the yarn brakes. After deflection of the clamping means with the aid of the guide pulleys 93 and 94, the base plate and, with it, the guide plate 125 are arranged vertically. In this position, these two parts are carried through a lateral slot 132, shown in FIG. 6, of a yarn guide 63, whereby the transported thread simultaneously comes into the range of the clamping device 107 and is clamped by it, so that the yarn guide 63 can begin in conventional manner the insertion of the thread in the needle hooks. The clamping means which has delivered this thread is thereafter deflected again by the guide pulley 95, the arm 115 of the swing lever 114 running onto the slide rail 106, which swings the clamping element 118 back into the position shown in FIG. 7. The released end of the thread is therefore now drawn through the gap between the base plate 112 and the brake pad 128 and the clamping means 89 is carried back to the guide pulley 91. The return of the yarn guide from the end to the beginning of the fabric may be effected in any desired manner.

The described mode of operation is the same for all the yarn guides 63 and clamping means 89. Moreover, the intervals between the individual yarn guides 63 and the individual clamping means 89 and the speeds of conveyance of these parts are so coordinated with one another that whenever a yarn guide 63 arrives at the end of the fabric a clamping means 89 also runs onto the slide rail 105, while at the beginning of the fabric every clamping means 89 carried over the guide pulley 94 is transported through the lateral slot 132 of a yarn guide 63.

In order to simplify the movement of the yarn eyelet carrier 57, it is provided that during the forward movement the even-numbered yarn guiding tubes 103 be arranged in the region of the guide pulley 91 and during the return movement the odd-numbered yarn guiding tubes 103 be arranged in this region. Instead of providing a slidable yarn eyelet carrier 57, the entire unit formed of the clamping means 89 could be swingably arranged. In this constructional form of the invention, an essential feature is to be seen in that the thread to be transported back to the beginning of the fabric is seized at a point which is located above the sheet of threads and is then returned to the beginning of the fabric outside the sheet of threads, i.e. each inner thread is drawn between the two neighbouring threads, while each outer thread is carried back or returned past the sheet of threads. Twisting together of the threads therefore cannot occur. Even a partial twisting together of the threads or rubbing of the threads on one another is not possible.

The invention is not limited to the embodiments described, but can be modified in many respects. In particular, magnetic or electrical arrangements may also be used in place of the described pneumatic and mechanical conveying and clamping arrangements, respectively. Basically, any arrangement can be employed which is suitable, departing from the state of the art, for bringing the ends of the inner threads back to the beginning of the fabric between the two neighbouring threads and the ends of the outer threads back to the beginning of the fabric past the sheet of threads. Such arrangements may also include drum, block or pulley, loop or other thread stores which serve to store each thread intermediately before it is returned to the beginning of the fabric. These thread stores are advantageous in particular when the yarn eyelet carrier 57 is arranged in the region of the beginning of the fabric or of the first half of the needle beds. If the working speed of this arrangement is not sufficient, a plurality of such arrangements may be provided.

The number of supply bobbins is generally equal to the number of knitting systems. Since, however, the thread cannot be returned infinitely rapidly to the beginning of the fabric, at least one supply bobbin is advantageously provided in addition for each kind of yarn. The speed of the belt 88 may be equal to, or greater than, the speed of the belt 64. Advantageously, however, the speed of the belt is substantially greater, so that the number of additional supply bobbins may be kept small.

A variation in the knitting width can be made by providing the cutting device 104 and the clamping device 107 at a different point, which is basically any point, of the needle bed.

Return conveyance of the thread ends via the location of the associated yarn eyelets, for example with the aid of the arrangements described, is appropriate in the majority of practical cases. This measure is never necessary, however, when the threads are transported back to the beginning of the fabric in a different manner within the sectors of space and planes described with the reference to FIG. 5.

Whereas in the constructional form according to FIG. 1 the distance of the yarn eyelets 59 from the end of the fabric is preferably equal to the distance of the yarn eyelets 59 from the beginning of the fabric, in the thread guiding system according to FIGS. 6 and 7 it is preferred to arrange the yarn eyelet carrier 57 in the region of the end of the fabric. Of course, in this constructional form, the yarn eyelet carrier 57 could also be arranged in the centre of the needle beds, for example by providing in place of the clamping means 89 a transport element conveyed from the yarn eyelets 59 in the direction of the beginning of the fabric and on which the thread slides with controlled friction without being clamped.

Moreover, in place of the clamping means 89 described with reference to FIGS. 6 and 7, a clamping means may be provided which has a braking element which brakes the thread more and more until it is finally brought to a stop by self-locking and is therefore clamped. In the constructional form according to FIG. 7, this could be effected by the slide rail 105 acting not on the clamping element 118, but on the brake pad 128, and pushing this more and more against the base plate 112 after the thread has been inserted in the gap between the brake pad 128 and the base plate 112, until the thread is finally clamped. Alternatively, so-called grid brakes can be used for this purpose, these brakes having two comb-like brake elements, the teeth of which interengage and deflect the thread to be braked repeatedly until self-locking occurs owing to the increased friction.

Finally, the invention is not limited to flat knitting machines, but can also be carried into effect in circular knitting machines in a manner shown in British Pat. No. 1,449,244 and U.S. Pat. No. 3,703,818 and other loop-forming machines.

What we claim is:

1. A method of automatically feeding to a loop forming machine a plurality of threads by a plurality of first thread guides and a plurality of second thread guides, said method comprising the steps of moving said second thread guides one after the other in one direction along an endless path each second guide having a first position corresponding to the beginning of and a second position corresponding to the end of a fabric produced by said machine; feeding said threads via said second guides to said machine only during movement of said second guides from said first position to said second position; cutting said threads for obtaining thread ends when said second guides arrive at said second position; drawing said thread ends out of said second guides at said second position; returning said thread ends back to said first position so that twisting of said plurality of said threads will not occur; returning said second guides back to said first position along said endless path; and inserting each of said returned thread ends into an associated one of said second returned thread guides at said first position for again feeding the thread associated with said thread end to said machine.

2. A method according to claim 1 wherein said thread ends are first conveyed in the direction of an associated one of said first thread guides and then in the direction of said first position.

3. A method according to claim 1, wherein each thread end is returned to said first position by means of an associated one of a plurality of transporting elements.

4. A method according to claim 1, wherein said thread ends are returned to said first position by means of suction and blowing means.

5. A method according to claim 1, wherein each thread end is returned to said first position through a predetermined space, said space substantially being defined by that section of said path located between said first and said second position and by the associated one of said first thread guides.

6. Apparatus for feeding a pluraity of threads to a loop forming machine, comprising: a plurality of first thread guides; a plurality of second thread guides; said second thread guides being movable along first an endless path one after the other in one direction, said first path having a first position corresponding to the beginning of and a second position corresponding to the end of a fabric produced by said machine; means for feeding said threads via said first and said second thread guides to said machine only during movement of said second thread guides from said first position to said second position; cutting means at said second position for cutting said threads for obtaining thread ends; means for drawing said thread ends out of said second guides and for returning said thread ends to said first position so that twisting of said plurality of threads will not occur; and means for inserting each returned thread end into an associated one of said second thread guides at said first position.

7. Apparatus according to claim 6, said inserting means including means located at said first position for holding said returned thread ends.

8. Apparatus according to claim 7, wherein said holding means include suction means.

9. Apparatus according to claim 6, wherein said drawing-out and returning means include at least one blowing tube having two ends, one end being mounted near said first position and the other end being mounted near said first thread guides, said blowing tube having a continuous longitudinal slot along one side thereof and facing said second position and means for blowing air flowing through said blow tube in the direction of said first position.

10. Apparatus according to claim 6, wherein said drawing-out and returning means include at least one clamping means movable along a second endless path for gripping said thread ends and transporting said thread ends to said first position.

11. Apparatus according to claim 9, and further comprising a swinging mechanism associated with said blowing tube by which that end of said blowing tube which is located near said first thread guides can be positioned in a preselected sequence to be near each of said plurality of first thread guides.

12. Apparatus according to claim 10, and further comprising a swinging mechanism associated with said clamping means by which said clamping means are aligned in a preselected sequence with each of said plurality of first thread guides.

13. Apparatus according to claim 9, and further comprising a guide carrier for supporting said first guides and a transport means associated with said guide carrier for adjusting said first thread guides in a preselected sequence at the end of said blowing tube near said thread guides.

14. Apparatus according to claim 10, and further comprising a guide carrier for supporting said first thread guides and a transport means associated with said guide carrier for adjusting said first thread guides in a preselected sequence near said second endless path.

15. Apparatus according to claim 13, wherein said guide carrier is disposed in a plane perpendicular to that section of said first endless path which is located between said first and said second positions.

16. Apparatus according to claim 14, wherein said carrier is disposed in a plane perpendicular to that section of said first endless path which is located between said first and said second positions.

17. Apparatus according to claim 13, wherein said first thread guides are disposed so that the distance from each first thread guide to said first position is equal to the distance to said second position.

18. Apparatus according to claim 14, wherein said first thread guides are disposed so that the distance from each first thread guide to said first position is equal to the distance to said second position.

19. Apparatus according to claimm 10, and comprising a plurality of clamping means, movable along said second endless path one after the other in one direction, wherein the distances between and the speed of movement of said second thread guides on said first endless path and the distances between and the speeds of movement of said clamping means on said second endless path are such that when a second thread guide arrives at said second position there is associated therewith one of said clamping means for accomodating the end of the thread guided by said arriving second thread guide and when a second thread guide arrives at said first position there is associated therewith one of said clamping means for inserting the end of the thread clamped by said clamping means into said arriving second thread guide.

20. Apparatus according to claim 19, wherein each of said clamping means includes a clamping element located along said second endless path for actuating each clamping element.

21. Apparatus according to claim 19, wherein each clamping means includes a brake pad and a base plate, spaced therefrom to form a gap, said thread end being insertable into said gap for being clamped therein for being drawn as far as its extreme end.

22. Apparatus according to claim 20, wherein each clamping element has at least one braking element, said thread ends being slidable there against with controlled friction.

23. Apparatus according to claim 22, wherein said braking elements are such that said thread ends may be clamped through self-locking.

24. Apparatus according to claim 6, wherein said drawing-out and returning means returns each thread end to said first position through a predetermined space, said space substantially being defined by that section of said path located between said first and said second position and by the associated one of said first thread guides.

* * * * *